US010835011B2

(12) United States Patent
Noh et al.

(10) Patent No.: US 10,835,011 B2
(45) Date of Patent: Nov. 17, 2020

(54) OXYGEN-MIXING COSMETIC CONTAINER

(71) Applicants: Ye Woo Noh, Seoul (KR); Ki Woo Noh, Seoul (KR)

(72) Inventors: Ye Woo Noh, Seoul (KR); Ki Woo Noh, Seoul (KR)

( * ) Notice: Subject to any disclaimer, the term of this patent is extended or adjusted under 35 U.S.C. 154(b) by 270 days.

(21) Appl. No.: 16/075,448

(22) PCT Filed: Mar. 25, 2016

(86) PCT No.: PCT/KR2016/003061
§ 371 (c)(1),
(2) Date: Aug. 3, 2018

(87) PCT Pub. No.: WO2017/164445
PCT Pub. Date: Sep. 28, 2017

(65) Prior Publication Data

US 2019/0053601 A1 Feb. 21, 2019

(51) Int. Cl.

| | |
|---|---|
| ***A45D 34/00*** | (2006.01) |
| ***A45D 33/02*** | (2006.01) |
| ***B65D 51/28*** | (2006.01) |
| ***B65D 81/32*** | (2006.01) |

(52) U.S. Cl.
CPC ..... *A45D 34/00* (2013.01); *A45D 33/02* (2013.01); *B65D 51/28* (2013.01); *B65D 81/32* (2013.01); *A45D 2200/057* (2013.01)

(58) Field of Classification Search
CPC ..... A45D 33/14; A45D 34/00; A45D 33/02; A45D 2200/057; B65D 81/32; B65D 51/28; B65D 55/022
USPC ..... 206/219, 220, 221; 211/8; 222/635, 631
See application file for complete search history.

(56) References Cited

U.S. PATENT DOCUMENTS 4,746,017 A * 5/1988 Howard ..... B65D 17/02 206/438
2018/0279743 A1* 10/2018 Yoo ..... B65D 81/32

FOREIGN PATENT DOCUMENTS

| | | | |
|---|---|---|---|
| EP | 2225166 | A1 | 9/2010 |
| JP | 49-124302 | U | 2/1974 |
| JP | 64-58661 | A | 3/1989 |
| JP | 64-58662 | A | 3/1989 |
| JP | 6741792 | B2 | 8/2020 |
| KR | 97-0001354 | B1 | 2/1997 |
| KR | 20-0270335 | Y1 | 4/2002 |
| KR | 10-2011-0079008 | A | 7/2011 |
| KR | 10-2011-0079009 | A | 7/2011 |
| KR | 10-2012-0026209 | A | 3/2012 |
| KR | 10-1149904 | B1 | 5/2012 |
| KR | 101149904 | B1 * | 6/2012 |
| KR | 20-2014-0005450 | U | 10/2014 |

(Continued)

*Primary Examiner* — Rafael A Ortiz
(74) *Attorney, Agent, or Firm* — Novick, Kim & Lee, PLLC; Jae Youn Kim

(57) ABSTRACT

An oxygen-mixing cosmetic container is proposed. In the cosmetic container, the structure of an oxygen supply cap, which is installed beneath an oxygen cap and a cosmetic container body, is improved such that, when the oxygen supply cap is coupled, oxygen is ejected simultaneously, components of the oxygen supply cap are simplified such that, besides reducing the material cost, the same can be assembled more efficiently, and the oxygen capsule, which is mounted on the oxygen supply cap, can be easily replaced.

4 Claims, 6 Drawing Sheets

(56) References Cited

FOREIGN PATENT DOCUMENTS

KR 10-2016-0055596 A 5/2016

* cited by examiner

OXYGEN-MIXING COSMETIC CONTAINER

TECHNICAL FIELD

The present invention relates to an oxygen-mixing cosmetic container for supplying oxygen to cosmetics contained in the container, and more particularly, to an oxygen-mixing cosmetic container having an improved structure of an oxygen capsule and an oxygen supply cap mounted on the bottom of a cosmetic container body, thereby making oxygen ejected as soon as the oxygen supply cap is combined to the cosmetic container body, reducing manufacturing costs and enhancing assemblability by simplifying components of the oxygen supply cap, and allowing a user to easily replace the oxygen capsule mounted in the oxygen supply cap.

BACKGROUND ART

In general, oxygen getting in contact with the skin promotes and activates discharge of toxin and waste matters in the skin and activates metabolism of the skin by strengthening breathing among skin cells.

Cosmetics containing oxygen ingredient use the principle that oxygen generating composite touches the skin and generates oxygen.

The oxygen ingredient serves as an aid to promote absorption of various skin nutriments into the skin.

Fine oxygen pellets absorbed into the skin effectively act in making the skin clear and cool.

Users who use the cosmetics containing oxygen ingredient feel that the skin becomes fresh and cool after using the cosmetics because oxygen promotes absorption of cosmetic ingredients into the skin or contributes to acceleration of absorption of cosmetic ingredients into the skin to some degree.

It has been known that cosmetics containing oxygen ingredient effectively acts to skin whitening.

It has been proved through various cases that various materials involved in skin whitening among various cosmetic ingredients showed better whitening effect in common when oxygen is replenished.

However, even though a great deal of oxygen is dissolved in cosmetic ingredients, manufactured in the form of pellets, and stored in a sealed container, because the oxygen is rapidly dissipated as soon as the container is opened during use, it is in fact difficult to supply sufficient oxygen in a state where oxygen is contained in the cosmetic ingredients, and it is impossible to supply pure oxygen which does not contain contaminants.

In general, cosmetic products containing oxygen ingredient do not contain oxygen as a direct ingredient but is contained in the cosmetic ingredients in the form of an oxygen generating materials, so generates oxygen when the oxygen generating material touches the skin during use. Therefore, it is difficult to supply sufficient oxygen because a small amount of oxygen is generated when a user uses the cosmetic product containing oxygen ingredient, and it is impossible to supply pure oxygen with high purity.

In order to solve the problems, Korean Patent No. 10-1149904 discloses an oxygen mixing cosmetic container for promoting absorption of specific nutrient ingredients of cosmetics into the skin because a great deal of oxygen with high purity, which is not directly involved in the cosmetic ingredients, is contained in cosmetics.

However, the conventional oxygen mixing cosmetic container disclosed in Korean Patent No. 10-1149904 has several disadvantages in that components of the cosmetic container are increased because a supply cap receiving a high pressure oxygen storage container is additionally combined beneath a main body of the cosmetic container and an outer cap is mounted, and in that it rises manufacturing costs and deteriorates assemblability due to inconvenience of use.

Additionally, in case of the conventional oxygen mixing cosmetic container, oxygen is ejected as soon as the supply cap to which the high pressure oxygen storage container is mounted is combined to the bottom of the container body, and in this instance, the outer cap covers the outside of the supply cap, but there is no meaning to mount the caps doubly. In addition, because the caps are doubly mounted, an inlet of the supply cap becomes narrower and it is difficult for users to grip an upper end portion of the high pressure oxygen container with the hand, so it is not easy to replace the high pressure oxygen container with a new one.

DISCLOSURE OF INVENTION

Technical Problem

Accordingly, the present invention has been made in view of the above-mentioned problems occurring in the prior art, and it is an object of the present invention to provide an oxygen-mixing cosmetic container having an improved structure of an oxygen capsule and an oxygen supply cap mounted on the bottom of a cosmetic container body, thereby making oxygen ejected as soon as the oxygen supply cap is combined to the cosmetic container body.

It is another object of the present invention to provide an oxygen-mixing cosmetic container capable of reducing manufacturing costs and enhancing assemblability by simplifying components of the oxygen supply cap.

It is a further object of the present invention to provide an oxygen-mixing cosmetic container capable of allowing a user to easily replace the oxygen capsule mounted in the oxygen supply cap to supply oxygen.

Technical Solution

To accomplish the above object, according to the present invention, there is provided an oxygen-mixing cosmetic container including: a body having a storing space of which the upper portion is open such that a cosmetic is contained therein; a cap combined to the upper portion of the body and having a nozzle and a pumping portion; a valve airtightly mounted at the center of the lower portion of the body and having a fracture rod protruding downwardly; an oxygen capsule having a fracture film rupturing by the fracture rod and connected to the valve to supply oxygen to the storing space of the body; a connecting tube formed integrally with the lower portion of the body to surround the lower portion of the valve and the upper portion of the oxygen capsule, and having an outer diameter smaller than that of the body; and an oxygen supply cap detachably coupled to the connecting tube, the oxygen supply cap having a capsule mounting portion to which the oxygen capsule is fit through a plurality of fixing pieces radially protruding from the inner-diameter lower portion such that oxygen is ejected.

Moreover, a male screw is formed on the outer circumferential surface of the connecting tube, and a female screw to be screw-coupled with the male screw is formed on the upper portion of the inner circumferential surface of the oxygen supply cap.

Furthermore, the connecting tube includes: insertion grooves opened at the lower portion and vertically formed at both sides of the outer circumferential surface of the connecting tube; elevation guide grooves inclinedly formed at the upper portion of the insertion grooves in a spiral direction; and fixing grooves horizontally formed at the upper portion of the elevation guide grooves. The oxygen supply cap includes fixing protrusions formed at both sides of the inner circumferential surface thereof to be inserted and fit into the fixing grooves through the insertion grooves.

Additionally, each of the fixing pieces has an inclined surface formed at the inner upper portion thereof to hold the upper portion of the oxygen capsule.

In addition, the body and the oxygen supply cap has the same outer diameter, and annular jaws are respectively formed on the lower end of the outer circumferential surface of the body and the upper end of the outer circumferential surface of the oxygen supply cap to prevent slip.

Advantageous Effects

As described above, the oxygen-mixing cosmetic container can make oxygen ejected as soon as the oxygen supply cap is combined to the cosmetic container body due to the improved structure that the oxygen capsule and the oxygen supply cap mounted on the bottom of the cosmetic container body are formed in a single unit, differently from the conventional oxygen mixing cosmetic containers.

Moreover, the oxygen-mixing cosmetic container can structurally reduce manufacturing costs and enhance assemblability of the oxygen supply cap due to simplification of the single unit of the oxygen supply cap.

Furthermore, the oxygen-mixing cosmetic container can allow the user to easily replace the oxygen capsule mounted in the oxygen supply cap to supply oxygen because the oxygen supply cap supporting the oxygen capsule has the inclined surfaces formed on the inner upper portions of the fixing pieces so that the user can easily grip the upper portion of the oxygen capsule.

BEST MODE FOR CARRYING OUT THE INVENTION

Figure 1:
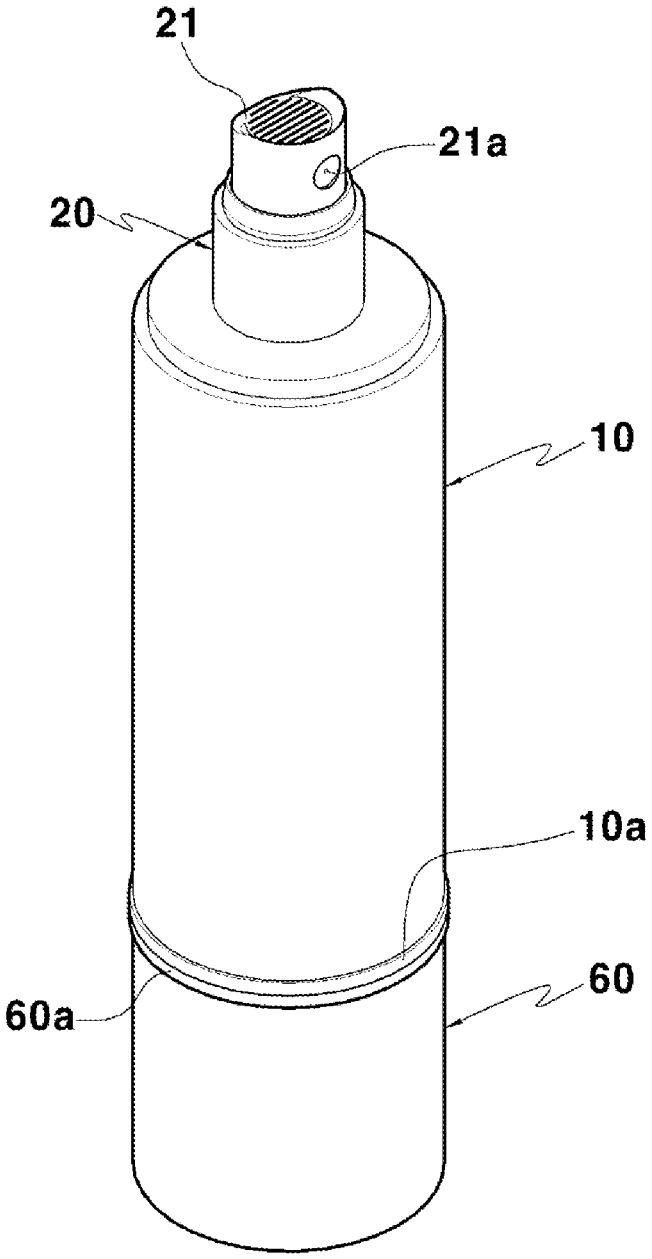
FIG. 1 is a perspective view of an oxygen-mixing cosmetic container according to the present invention.

Hereinafter, a technical structure of the present invention will be described in detail with reference to the accompanying drawings.

As shown in FIGS. 1 to 6, an oxygen-mixing cosmetic container includes: a body 10 having a storing space 11 of which the upper portion is open such that a cosmetic is contained therein; a cap 20 combined to the upper portion of the body 10 and having a pumping portion 21 in which a nozzle 21*a* is formed; a valve 30 airtightly mounted at the center of the lower portion of the body 10 and having a fracture rod 31 protruding downwardly; an oxygen capsule 40 having a fracture film 41 rupturing by the fracture rod 31 of the valve 30 to supply oxygen to the storing space 11 of the body 10; a connecting tube 50 formed integrally with the lower portion of the body 10 to surround the lower portion of the valve 30 and the upper portion of the oxygen capsule 40, and having an outer diameter smaller than that of the body 10; and an oxygen supply cap 60 detachably coupled to the connecting tube 50, the oxygen supply cap 60 having a capsule mounting portion 62 to which the oxygen capsule 40 is fit through a plurality of fixing pieces 61 radially protruding from the inner-diameter lower portion such that oxygen is ejected.

Here, the oxygen-mixing cosmetic container is capable of promoting absorption of specific nutrient ingredients of cosmetics into the skin by containing oxygen in cosmetics, sufficiently supplying pure oxygen, which does not contain contaminants, to the cosmetics separately from cosmetic ingredients, continuously supplying oxygen to the cosmetics regardless of whether or not oxygen generating materials are contained, and allowing a user to refill and reuse cosmetics. Such an oxygen-mixing cosmetic container includes the body 10, the cap 20, the valve 30, the oxygen capsule 40, the connecting tube 50, and the oxygen supply cap 60. The body 10 is a body of the oxygen-mixing cosmetic container, and has the storing space 11 of which the upper portion is open such that the cosmetic is contained therein. In this instance, it is preferable that the body 10 be formed with a transparent body so that the user can easily check conditions of the cosmetic contained in the storing space 11 from the outside.

The cap 20 is detachably combined to the upper portion of the body 10 to seal the storing space 11, and has the pumping portion 21 disposed on the upper portion of the cap 20 to discharge the cosmetic to the outside through the nozzle 21*a*. In this instance, a valve 22 and a discharge tube 23 are mounted on the lower portion of the pumping portion 21. Therefore, when the user presses the pumping portion 21, the valve 22 is opened, and mixture liquid of the cosmetic and oxygen is discharged out along the discharge tube 23 through the nozzle 21*a*.

The valve 30 is airtightly mounted at the center of the lower portion of the body 10, and has the fracture rod 31 mounted at the lower portion of the valve 30 to rupture the fracture film 41 of the oxygen capsule 40 and supply oxygen to the storing space 11 of the body 10. In this instance, the valve 30 is opened and closed by pressure, namely, is opened by external pressure and is closed by internal pressure.

The oxygen capsule 40 has the fracture film 41 rupturing by the fracture rod 31 of the valve 30 to supply oxygen to the storing space 11 of the body 10. The oxygen capsule 40 is filled with oxygen compressed at high pressure. In this instance, when the user pushes the oxygen capsule 40 into the fracture rod 31, the fracture film 41 ruptures, and at the same time, oxygen is ejected to the fracture rod 31, so that the valve 30 is opened by pressure of the oxygen. Therefore, the oxygen compressed at high pressure and ejected from the oxygen capsule 40 is supplied to the storing space 11 of the body 10 through the fracture rod 31 and the valve 30.

The connecting tube 50 is formed integrally with the lower portion of the body 10 to have the outer diameter smaller than that of the body 10. The connecting tube 50 has the space formed therein to surround the lower portion of the valve and the upper portion of the oxygen capsule 40. In this instance, the connecting tube 50 serves to detachably combine the oxygen supply cap 60 to the lower portion of the body 10.

As soon as the oxygen supply cap 60 is detachably combined to the connecting tube 50, oxygen is ejected. Such an oxygen supply cap 60 has the plurality of fixing pieces 61 radially and integrally formed on the inner-diameter lower portion, and a capsule mounting portion 62, to which the oxygen capsule 40 is fit, is formed at the center of the inside of the fixing pieces 61. In this instance, when the oxygen supply cap 60 is combined to the connecting tube 50 after the oxygen capsule 40 is mounted in the capsule mounting portion 62 of the oxygen supply cap 60, the fracture rod 31 of the valve 30 ruptures the fracture film 41 while being forcedly pressed into the fracture film 41 of the oxygen capsule 40. So, when the oxygen supply cap 60 is combined, oxygen is ejected, and is supplied to the storing space 11 of the body 10 through the fracture rod 31 and the valve 30. In the meantime, the oxygen supply cap 60 is made with a transparent or opaque body.

The plurality of fixing pieces 61 are radially formed at the inner diameter lower portion of the oxygen supply cap 60, and serves to support the outer face of the oxygen capsule 40.

Figure 3:
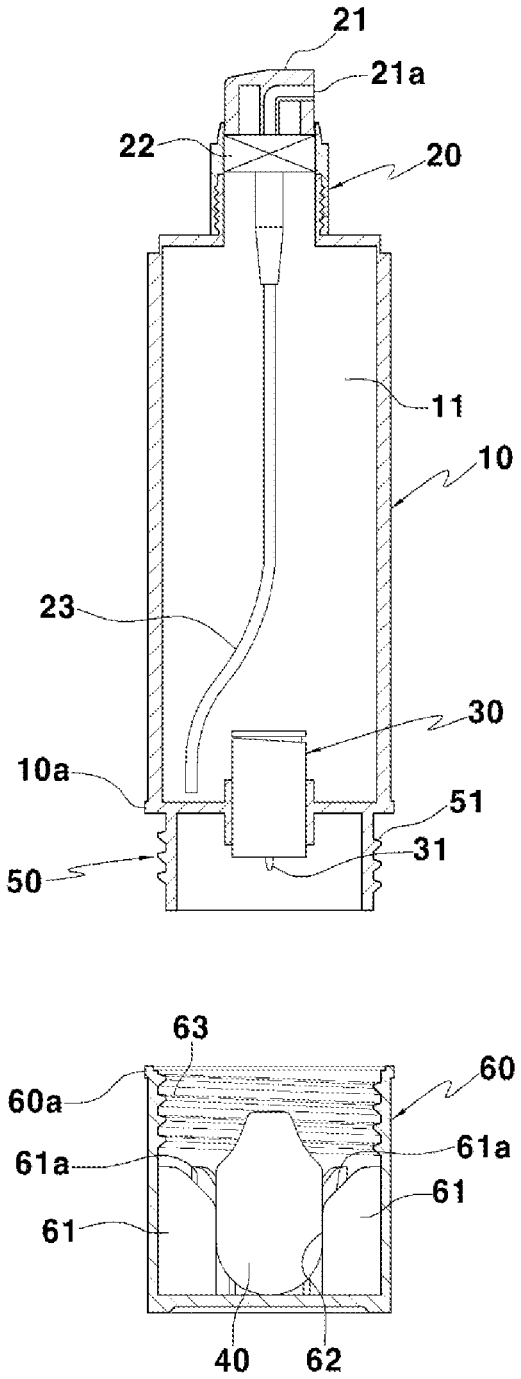
FIG. 3 is a sectional view showing a separated state of the oxygen-mixing cosmetic container according to the present invention.
Figure 4:
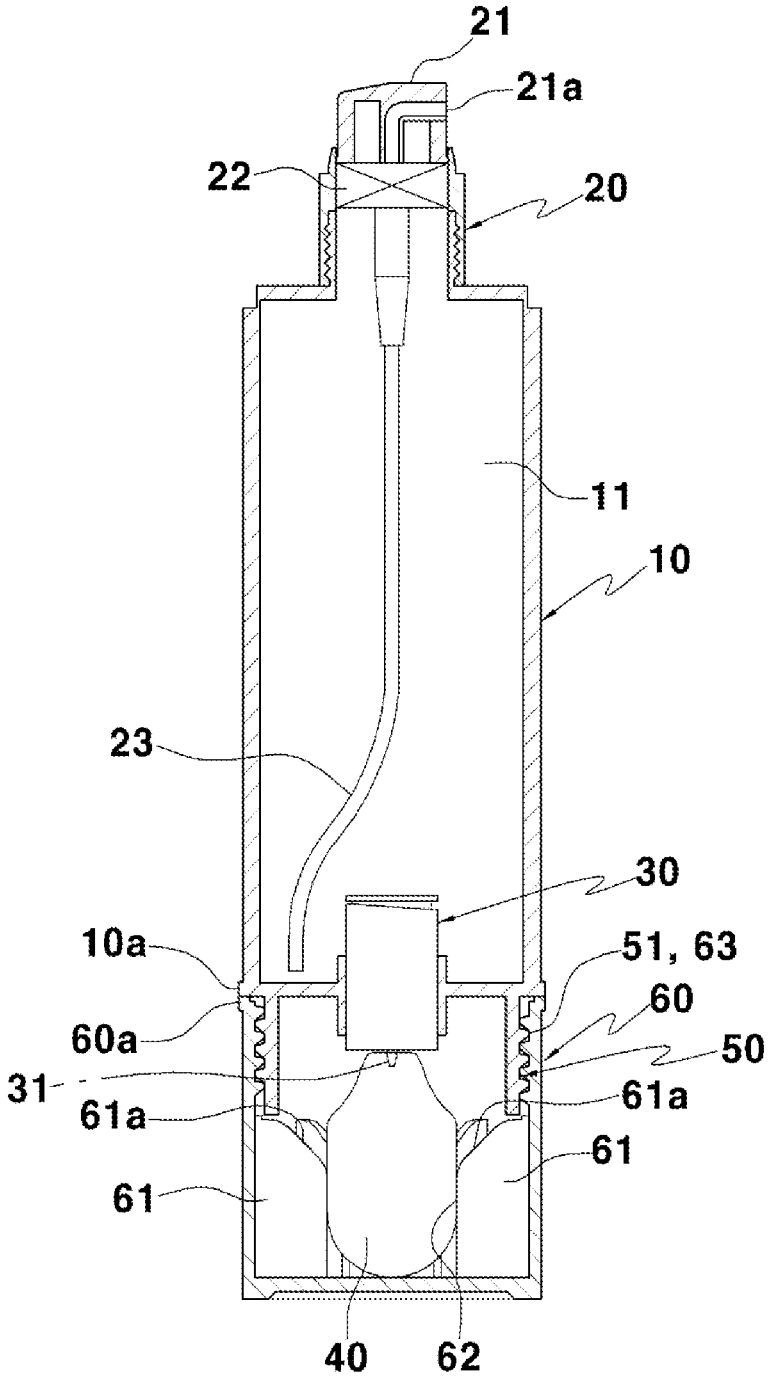
FIG. 4 is a sectional view showing a combined state of the oxygen-mixing cosmetic container.
Figure 5:
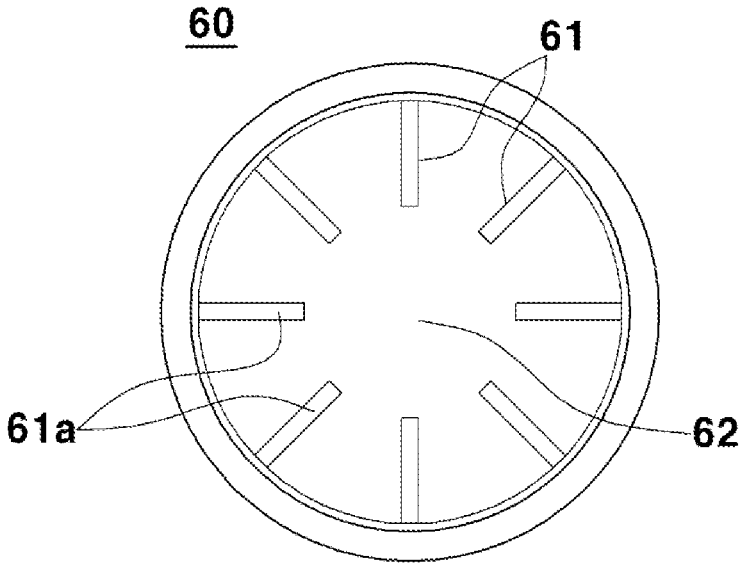
FIG. 5 is a plan view of an oxygen supply cap of the oxygen-mixing cosmetic container.

According to the present invention, as shown in FIGS. 3 and 4, each of the fixing pieces 61 has an inclined surface 61*a* formed at the inner upper portion thereof to hold the upper portion of the oxygen capsule 40. In this instance, because a gripping space is formed at the inner upper portion of the fixing pieces 61 by the inclined surfaces 61*a*, when the user inserts his or her finger into the gripping space formed by the inclined surfaces 61*a* and holds the upper portion of the oxygen capsule 40, the user can easily pick out the oxygen capsule 40 to replace the oxygen capsule 40.

The capsule mounting portion 62 is formed at the inner central portion of the fixing pieces 61, and the oxygen capsule 40 is fit in the capsule mounting portion 62.

Figure 2:
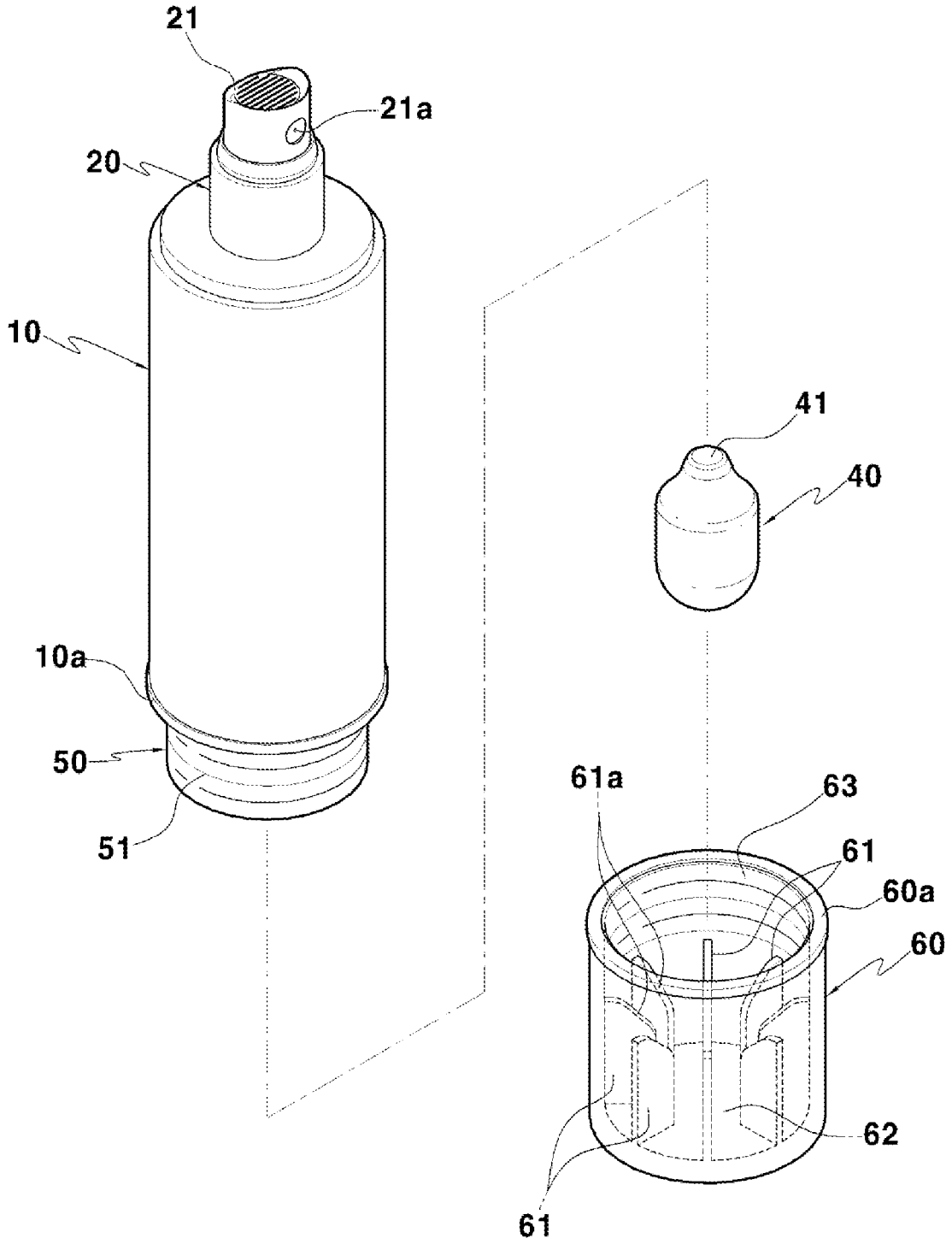
FIG. 2 is an exploded perspective view of the oxygen-mixing cosmetic container according to an embodiment of the present invention.

According to an embodiment of the present invention, as shown in FIGS. 2 to 4, a male screw 51 is formed on the outer circumferential surface of the connecting tube 50, and a female screw 63 to be screw-coupled with the male screw 51 is formed on the upper portion of the inner circumferential surface of the oxygen supply cap 60. In this instance, when the male screw 51 and the female screw 63 are coupled with each other, the oxygen supply cap 60 is simply and firmly coupled to the connecting tube 50. The oxygen supply cap 60 coupled firmly is not separated by pressure of the oxygen ejected when being combined.

Figure 6:
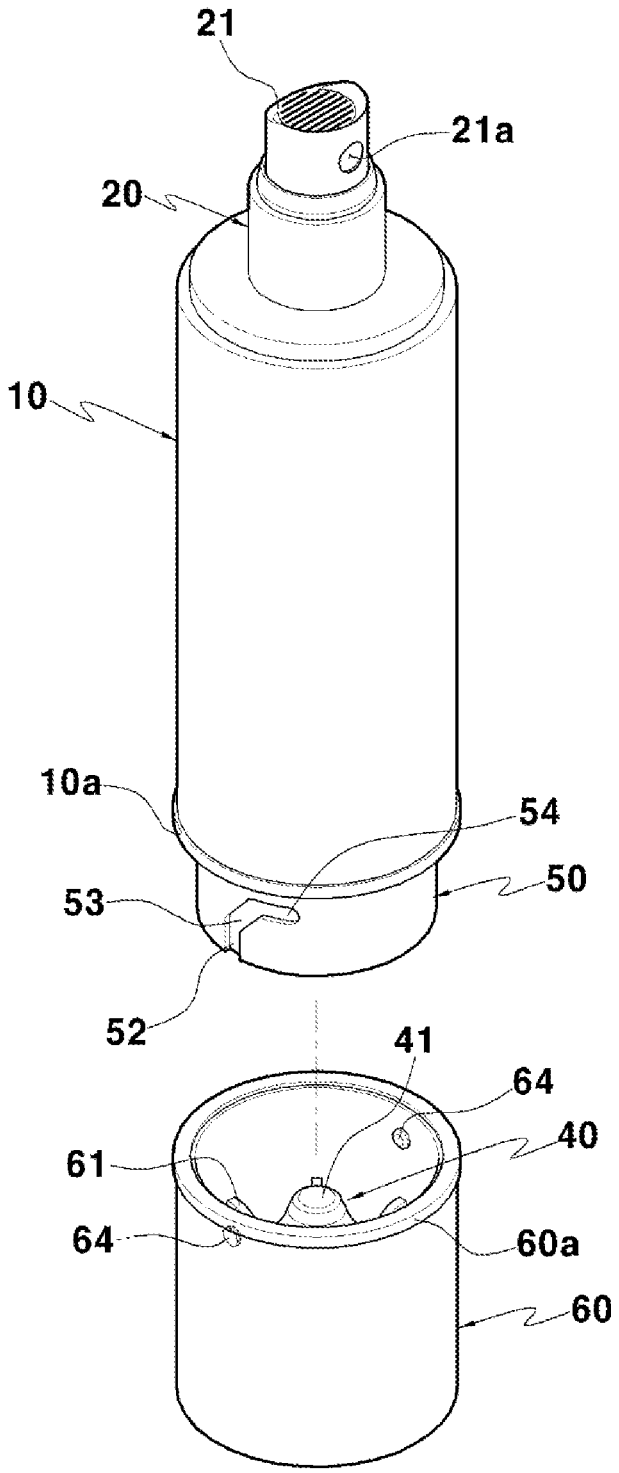
FIG. 6 is an exploded perspective view of an oxygen-mixing cosmetic container according to another embodiment of the present invention.

According to another embodiment of the present invention, as shown in FIG. 6, the connecting tube 50 includes: insertion grooves 52 opened at the lower portion and vertically formed at both sides of the outer circumferential surface of the connecting tube 50; elevation guide grooves 53 inclinedly formed at the upper portion of the insertion grooves 52 in a spiral direction; and fixing grooves 54 horizontally formed at the upper portion of the elevation guide grooves 53. The oxygen supply cap 60 includes fixing protrusions 64 formed at both sides of the inner circumferential surface thereof to be inserted and fit into the fixing grooves 54 through the insertion grooves 52 and the elevation guide grooves 53. In this instance, when the fixing protrusions 64 are inserted into the insertion grooves 52 and rotated toward the fixing grooves 54, the fixing protrusions 64 are fit and coupled with the fixing grooves 54 while going up along the inclined surfaces of the elevation guide grooves 53, so that the oxygen supply cap 60 can be simply and firmly combined to the connecting tube 50, and the firmly combined oxygen supply cap 60 is not separated by pressure of the oxygen ejected when being combined.

In the meantime, according to the present invention, the body 10 and the oxygen supply cap 60 has the same outer diameter to make the appearance beautiful, and annular jaws 10*a* and 60*a* are respectively formed on the lower end of the outer circumferential surface of the body 10 and the upper end of the outer circumferential surface of the oxygen supply cap 60 to prevent slip when they are coupled with each other.

Therefore, the oxygen-mixing cosmetic container can make oxygen ejected as soon as the oxygen supply cap 60 is combined to the body 10 due to the improved structure that the oxygen capsule 40 and the oxygen supply cap 60 mounted on the bottom of the body 10 are formed in a single unit, differently from the conventional oxygen mixing cosmetic containers.

Moreover, the oxygen-mixing cosmetic container can reduce manufacturing costs and enhance assemblability of the oxygen supply cap 60 due to simplification of the single unit of the oxygen supply cap 60.

Furthermore, the oxygen-mixing cosmetic container can allow the user to easily replace the oxygen capsule 40 mounted in the oxygen supply cap 60 to supply oxygen because the oxygen supply cap 60 supporting the oxygen capsule 40 has the inclined surfaces 61*a* formed on the inner upper portions of the fixing pieces 61 so that the user can easily grip the upper portion of the oxygen capsule 40.

INDUSTRIAL APPLICABILITY

According to the embodiments of the present invention, the oxygen-mixing cosmetic container can make oxygen ejected as soon as the oxygen supply cap is combined to the cosmetic container body due to the improved structure that the oxygen capsule and the oxygen supply cap mounted on the bottom of the cosmetic container body are formed in a single unit, differently from the conventional oxygen mixing cosmetic containers.

Moreover, the oxygen-mixing cosmetic container can structurally reduce manufacturing costs and enhance assemblability of the oxygen supply cap due to simplification of the single unit of the oxygen supply cap.

Furthermore, the oxygen-mixing cosmetic container can allow the user to easily replace the oxygen capsule mounted in the oxygen supply cap to supply oxygen because the oxygen supply cap supporting the oxygen capsule has the inclined surfaces formed on the inner upper portions of the fixing pieces so that the user can easily grip the upper portion of the oxygen capsule.

The invention claimed is:

1. An oxygen-mixing cosmetic container comprising:

a body having a storing space of which an upper portion is open such that a cosmetic is contained therein;

a cap combined to the upper portion of the body and having a pumping portion in which a nozzle is formed;

a valve airtightly mounted at a center of a lower portion of the body and having a fracture rod protruding downwardly;

an oxygen capsule having a fracture film rupturing by the fracture rod of the valve to supply oxygen to the storing space of the body;

a connecting tube formed integrally with the lower portion of the body to surround a lower portion of the valve and an upper portion of the oxygen capsule, and having an outer diameter smaller than that of the body; and an oxygen supply cap detachably coupled to the connecting tube, the oxygen supply cap having a capsule mounting portion to which the oxygen capsule is fit through a plurality of fixing pieces radially protruding from an inner-diameter lower portion such that oxygen is ejected, wherein the body and the oxygen supply cap respectively have the same outer diameter, and annular jaws are respectively formed on a lower end of an outer circumferential surface of the body and an upper end of an outer circumferential surface of the oxygen supply cap to prevent slip.

2. The oxygen-mixing cosmetic container according to claim 1, wherein a male screw is formed on an outer circumferential surface of the connecting tube, and a female screw to be screw-coupled with the male screw is formed on an upper portion of an inner circumferential surface of the oxygen supply cap.

3. The oxygen-mixing cosmetic container according to claim 1, wherein each of the fixing pieces has an inclined surface formed at an inner upper portion thereof to hold the upper portion of the oxygen capsule.

4. An oxygen-mixing cosmetic container comprising:

a body having a storing space of which an upper portion is open such that a cosmetic is contained therein;

a cap combined to the upper portion of the body and having a pumping portion in which a nozzle is formed;

a valve airtightly mounted at a center of a lower portion of the body and having a fracture rod protruding downwardly;

an oxygen capsule having a fracture film rupturing by the fracture rod of the valve to supply oxygen to the storing space of the body;

a connecting tube formed integrally with the lower portion of the body to surround a lower portion of the valve and an upper portion of the oxygen capsule, and having an outer diameter smaller than that of the body; and an oxygen supply cap detachably coupled to the connecting tube, the oxygen supply cap having a capsule mounting portion to which the oxygen capsule is fit through a plurality of fixing pieces radially protruding from an inner-diameter lower portion such that oxygen is ejected, wherein the connecting tube includes:

insertion grooves opened at a lower portion thereof and vertically formed at both sides of an outer circumferential surface of the connecting tube;

elevation guide grooves inclinedly formed at an upper portion of the insertion grooves in a spiral direction; and fixing grooves horizontally formed at an upper portion of the elevation guide grooves, and fixing protrusions formed at both sides of an inner circumferential surface of the oxygen supply cap to be inserted and fit into the fixing grooves through the insertion grooves and the elevation guide grooves.

* * * * *